US006354125B1

(12) United States Patent
Bernelf et al.

(10) Patent No.: US 6,354,125 B1
(45) Date of Patent: Mar. 12, 2002

(54) APPARATUS AND METHOD FOR HYDROFORMING WORKPIECES

(75) Inventors: Claes S Bernelf, Ljungby; Kenneth A Hedin, Lagan, both of (SE)

(73) Assignee: Automation, Press and Tooling AP&T AB (SE)

( * ) Notice: Subject to any disclaimer, the term of this patent is extended or adjusted under 35 U.S.C. 154(b) by 0 days.

(21) Appl. No.: 09/674,943

(22) PCT Filed: May 10, 1999

(86) PCT No.: PCT/SE99/00782

§ 371 Date: Mar. 19, 2001

§ 102(e) Date: Mar. 19, 2001

(87) PCT Pub. No.: WO99/58266

PCT Pub. Date: Nov. 18, 1999

(30) Foreign Application Priority Data

May 11, 1998 (SE) ..... 9801636

(51) Int. Cl.[7] ..... B21D 26/02

(52) U.S. Cl. ..... 72/60; 72/57; 72/63; 72/448

(58) Field of Search ..... 72/57, 60, 61, 72/63, 446, 448

(56) References Cited

U.S. PATENT DOCUMENTS

| | | | | | |
|---|---|---|---|---|---|
| 3,545,241 | A | * | 12/1970 | Grankowski et al. | 72/63 |
| 3,875,778 | A | * | 4/1975 | Hellgren | 72/63 |
| 3,938,361 | A | * | 2/1976 | Claesson et al. | 72/63 |
| 4,573,335 | A | * | 3/1986 | Persson | 72/63 |
| 4,658,618 | A | * | 4/1987 | Hellgren | 72/63 |
| 4,676,086 | A | * | 6/1987 | Hellgren | 72/63 |
| 4,711,111 | A | * | 12/1987 | Hellgren | 72/63 |

FOREIGN PATENT DOCUMENTS

| | | |
|---|---|---|
| EP | 0 686 440 | 12/1995 |
| WO | WO95/31322 | 11/1995 |

* cited by examiner

*Primary Examiner*—David Jones
(74) *Attorney, Agent, or Firm*—Bachman & LaPointe, P.C.

(57) ABSTRACT

An apparatus for hydroforming workpieces includes a first (11) and a second tool part (13) and a press device (1, 6, 7) which closes and holds together the tool parts during a forming cycle. The first tool part (11) is mounted in the press device (1, 6, 7). The second tool part (13) is disposed for insertion into and removal from the press device (1, 6, 7), for example with the aid of a conveyor (8). Further, the apparatus includes a supply of pressurized fluid (12) to the first tool part (11).

19 Claims, 4 Drawing Sheets

APPARATUS AND METHOD FOR HYDROFORMING WORKPIECES

TECHNICAL FIELD

The present invention relaters to an apparatus for hydroforming workpieces and comprises a forming tool with at least a first tool part and at least a second tool part, a press device for closing and holding together the tool parts during a forming cycle, and means for supplying a pressurised fluid to the tool during the forming cycle.

The present invention also relates to a method of hydroforming workpieces and comprises the steps that at least one workpiece is placed in a tool which is closed, whereafter forming takes place and the formed workpiece is removed from the tool

BACKGROUND ART

In this application, the term hydroforming is taken to signify a forming method in which a workpiece of sheeting or tubing is directly subjected to a liquid under high pressure in order, under the action thereof, to be formed in or against a tool. The fluid may, in this context, be water, a water/oil emulsion, oil, etc. Hydroforming can achieve extremely high levels of accuracy and surface fineness in the processes workpiece.

WO 95/31322 discloses an apparatus for hydroforming. This apparatus consists of an outer frame in which there are disposed press devices displaying short stroke length, but with extremely high pressing force. A tool unit is divided into a plurality of components and provided with a workpiece outside the press device and is also assembled outside the press device. After assembly of the tool and the workpiece, the tool is inserted as a unit into the press device where it is dosed and held together at the same time as the hydroforming operation takes place in the tool. After completed forming, the tool is removed as a unit and emptied outside the press device. Thus, the press device serves the function of a separate tool locking means.

While the design and construction according to the above-mentioned PCT publication may, in certain cases, function satisfactorily, it is, however, in many situations impractical and slow in operation. This applies particularly to such situations where workpieces of relatively simple shape are to be produced.

Problem Structure

The present invention has for its object to design the apparatus intimated by way of introduction such that it makes for extremely rational production at low costs. The same applies also to the method intimated by way of introduction. A further object of the present invention is to make it possible also to manufacture workpieces of different shapes in rapid sequence after each other.

Solution

The objects forming the basis of the present invention will be attained in respect of the apparatus if this is characterized in that the first tool part is mounted in the press device, while the second tool part is disposed for insertion in the press device prior to a forming cycle, and for removal from the press device after the forming cycle.

The objects forming the basis of the present invention will be attained in respect of the method if this is characterized in that a first tool part is held fixedly and immovably during a work cycle, that at least a second tool part is provided with a workpiece, that the second tool part with the workpiece is brought to a position in connection with the fist tool part and that the tool is closed by displacement of the second tool part and the workpiece, whereafter the forming takes place.

Further advantages will be attained if the apparatus is also given one or more of the characterizing features as set forth in appended subclaims 2 to 5 and if the method is also given one or more of the characterizing features as set forth in appended subclaims 7 and 8.

BRIEF DESCRIPTION OF THE ACCOMPANYING DRAWINGS

The present invention will now be described in greater detail hereinbelow, with reference to the accompanying Drawings. In the accompanying Drawings.

DESCRIPTION OF PREFERRED EMBODIMENT

Figure 1:
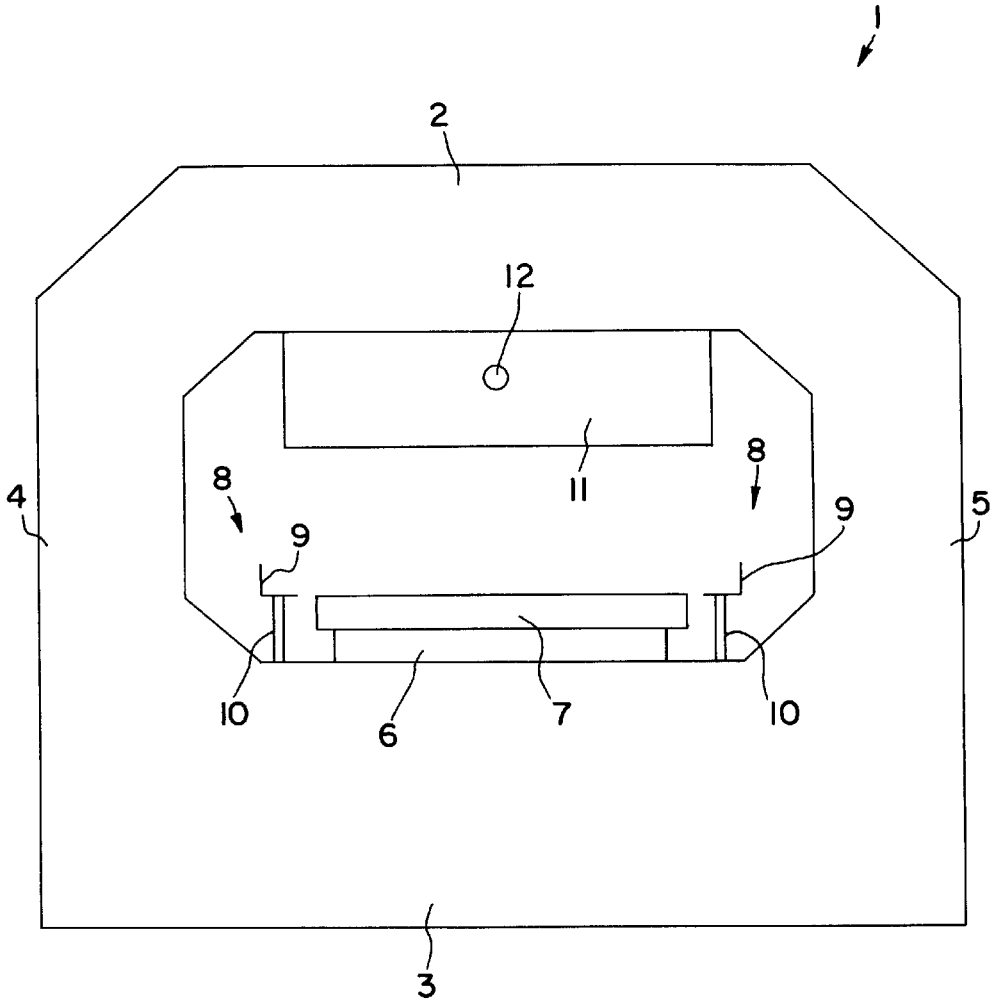
FIG. 1 shows an apparatus according to the present invention seen in the direction along which a tool part and a workpiece are fed into the apparatus.
Figure 2:
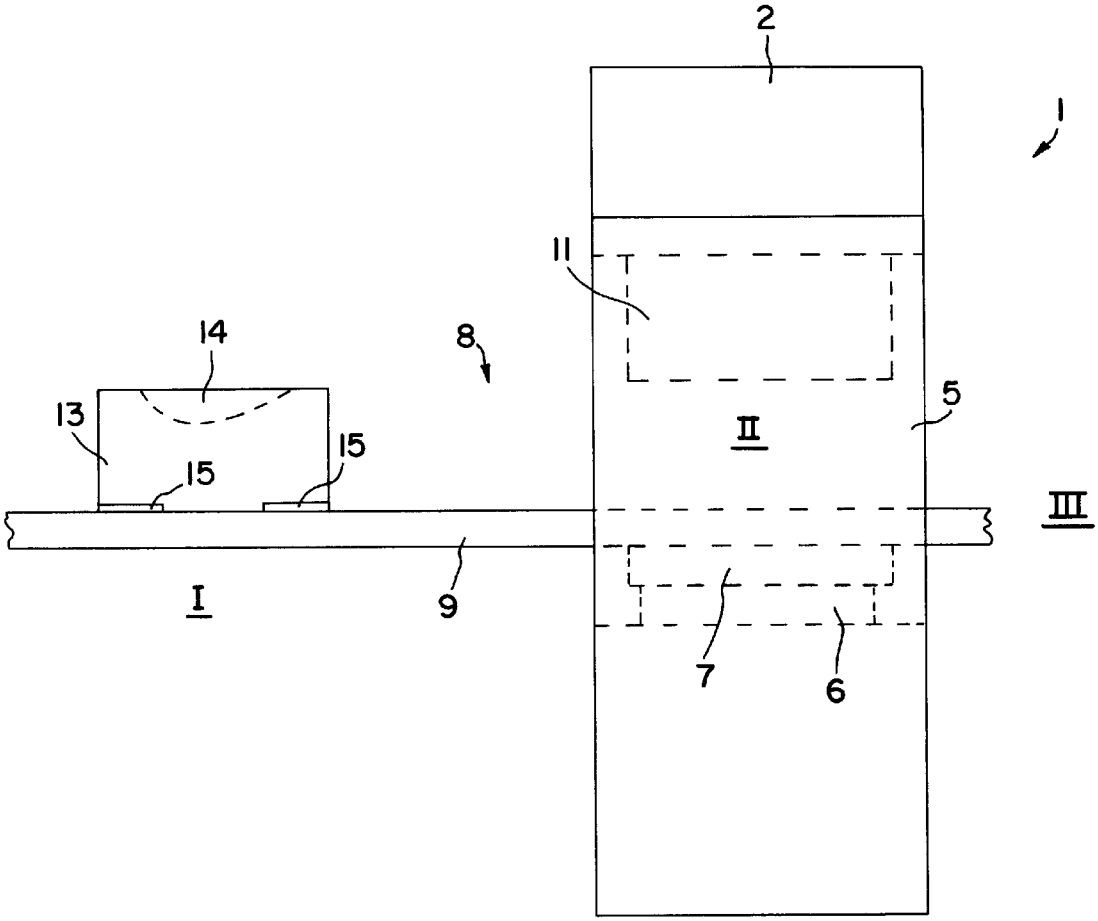
FIG. 2 shows the apparatus of FIG. 1, seen in a direction from right to left in FIG. 1.

In FIGS. 1 and 2, reference numeral 1 relates to a frame which is intended for absorbing extremely great forces. The frame 1 has an upper section 2, a lower section 3 and side sections 4 and 5. The frame 1 is to be considered as a frame in a hydraulic press which has been dimensioned in such a manner that it can absorb forces of the order of magnitude of MN or more without undergoing any appreciable deformation. The technology for realising such a frame is well known in the art and, as a result, needs not be commented on in greater detail.

On the lower section 3 of the frame 1, there is disposed a force generating unit 6 on which rests a lifting table 7. The force generating unit is dimensioned to realise forces of the same order of magnitude as the frame 1 is dimensioned to withstand. The force generating unit is designed for short stroke lengths, often a few or a few tens of millimetres, but for extremely great force and may include one or more hydraulic cylinders which each have a relatively slight ram surface area but which together have the large ram surface area which is required for the above-mentioned force generation. An assembly for the supply of hydraulic fluid under pressure is connected to the force generating unit 6 but will not be illustrated and described further. Correspondingly, the requisite control and regulation equipment is provided, but nor will this be described in greater detail.

A conveyor 8 is provided for the insertion of a tool part into the frame to a position I on the lifting table 7 before a forming cycle and for removing the tool part after the forming cycle. In its simplest form, the conveyor may be described as a pair of roller rails 9 which, with the aid of suitable supports or mounting members 10, are disposed on either side of the lifting table 7 at a height intended therefore in relation to the lifting table 7 in its lower position of rest.

FIG. 1 shows, at reference numeral 11, a first tool part which, while naturally being replaceable, is to be considered as immobile and permanently mounted in the frame 1 during operation. The first tool part has an inlet 12 for the supply of pressurised fluid, preferably a liquid which is used for forming a workpiece and which, in such instance, is preferably in direct action and contact with the workpiece.

In its simplest form, the first tool part 11 has a planar underside with one or more outlets for the above-mentioned pressurised fluid. If the workpiece, prior to a forming operation, is a flat sheet, his design of the underside will realise an adequate sealing against the workpiece in order to build up, between the workpiece and the underside, a sufficient fluid pressure for forming the workpiece.

FIG. 2 shows a second or lower tool part 13 which, in its upper surface, has a mould cavity 14. The second tool part 13 is movable between a position I located outside the frame 1 where a workpiece is placed on the tool part, to a position II located in the frame 1 in connection with the first tool part 11, the position II also being shown in FIG. 3. In order to achieve this mobility of the second tool part, this tool part may suitably be provided with roller means 15, with rollers which rest on the roller rails 9.

As will be apparent from FIG. 2, the conveyor 8 (i.e. in this embodiment the roller rails 9) may be disposed to be through-going in the frame 1 so that the lower tool part 13 may be displaced from the position I illustrated in FIG. 2 to a position II (FIG. 3) located interiorly in the frame 1, and to a position III in FIG. 2 located to the right of the frame 1. The reason for this is that, in position I, a workpiece is applied on the second tool part 13, in position II, the work cycle is carried out interiorly in the frame 1, and in position II, the finished workpiece is removed from the second tool part. The second tool part may then be recycled in one suitable way or another back to position II or possibly be provided with a new workpiece in position III and returned to position II for processing and thereafter to position I for removal of the workpiece.

The present invention also encompasses the possibility of employing a plurality of variously designed second or lower tool parts which have mould cavities of different shapes. This implies that the workpieces, after the forming cycle, will have different appearances. This is possible in that the first tool part may in principle be designed with a totally planar lower surface which, prior to the forming cycle with the tool dosed (according to FIG. 4), sealingly abuts against the upper side of the workpiece.

Figure 3:
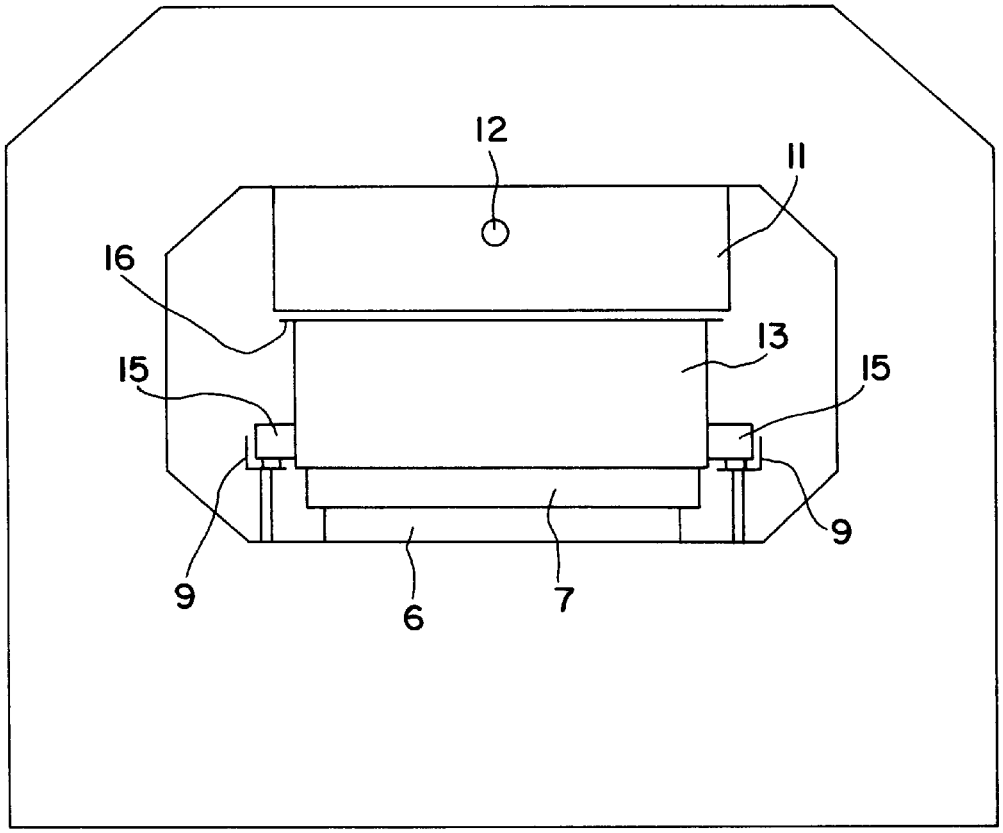
FIG. 3 is a view corresponding to that of FIG. 1 of the apparatus with a tool part inserted therein in the open state.

In FIG. 3, the second tool part 13 is shown inserted in the frame 1 before the force generating unit 6 has lifted the lifting table 7 up into abutment against the underside of the second tool part 13, i.e. before the tool is closed. In practice, only the play between the upper side of the lifting table 7 and the lower side of the second tool part 13 which is sufficient to make possible rolling-in of the second tool part 13 to the position shown in FIG. 3 is required. In practice, a clearance or play of one or a few millimetres would probably be sufficient In FIG. 3, a workpiece 16 in the form of a substantially planar sheet has been shown resting on the second tool part 13. In the Figure, edge portions of the workpiece 16 extend outside the periphery of the second tool part. On the other hand, in a practical embodiment it is probable that the second tool part 13 would be provided with retainer members which, in a horizontal direction, prevent the workpiece 16 from sliding on the upper side of the tool part. In such an embodiment, the edge portions of the workpiece 16 would be located inside the outer periphery of the second tool part. Such retainer members for the workpiece may be designed as an outer frame around the periphery of the second tool part, but may, for example, also comprise magnets, suction devices or the like. Further, there are provided sealing means around the periphery of the mould cavity 14 which, when the tool is closed, press the workpiece 16 into sealing abutment against the first tool part 11.

Figure 4:
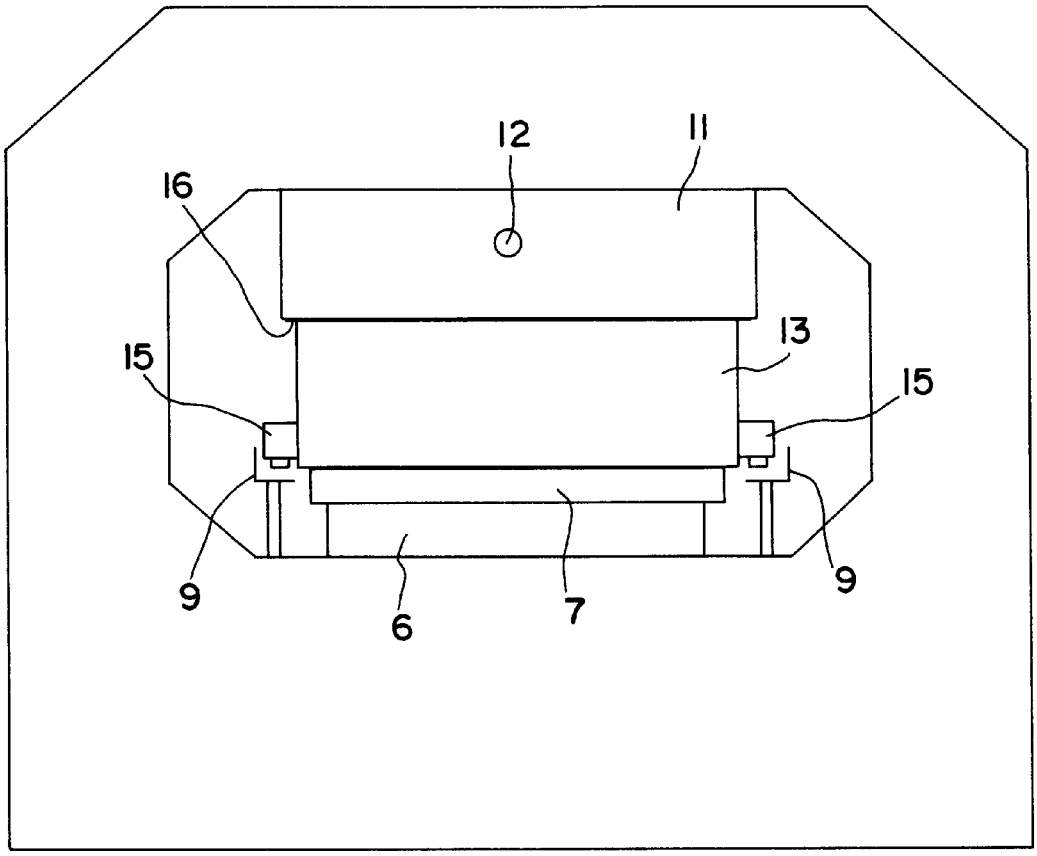
FIG. 4 is a view corresponding to FIGS. 1 and 3 in a position where the tool is closed.

In FIG. 4, the force generating unit 6 has been activated so that the lifting table 7 has been brought into abutment against the underside of the second tool part 13 and its roller means 15 have been lifted from the roller rails 9. In this position, the workpiece 16 is pressed with great force between the first and second tool parts, sealing taking place between the upper side of the workpiece 16 and the lower side of the first tool part 11. In the position according to FIG. 4, pressurised fluid is supplied via the inlet 12 to the interface between the upper side of the workpiece 16 and the lower side of the first tool part 11, whereupon the workpiece bulges downwards into the mould cavity 14 (FIG. 2) in the second tool part 13. The supply of pressure medium to the upper side of the workpiece 16 is carried out for such a length of time and with such great volume that the workpiece is pressed hard down against the defining walls of the mould cavity 14 and with such great force that the workpiece is shaped in accordance with the shape of the mould cavity with consummate accuracy.

Once the forming of the workpiece has taken place according to FIG. 4, the lifting table 7 is once again lowered, whereafter the second tool part 13 and the finished workpiece are removed from the frame 1, where the second tool part is released from the workpiece. Thereafter, the cycle is repeated with the same or an identical or otherwise formed second tool part.

In the foregoing, the underside of the first tool part has been described as being substantially planar. However, according to the present invention, it is possible also to provide this tool part with a mould cavity which in such an event, would correspond to the mould cavity 14. In this alternative, the second tool part 13 also has an inlet for pressurised fluid which is employed for pressing the workpiece into the mould cavity which is placed in the first tool part. If, in such instance, the area of the mould cavity in the upper tool part is considerably smaller than the area of the mould cavity 14 in the second tool part, the workpiece may first be pressed in an upward direction under the action of pressurised fluid which is supplied via the second tool part, whereafter a second forming takes place in a downward direction by means of pressurised fluid which is supplied via the inlet 12 in the first tool part.

As an alternative to the mutual placing of the first and second tool parts 11 and 13, respectively, as shown on the Drawings, it is also possible to provide an arrangement where the plane of division between the tool parts is vertical, i.e. the workpiece stands upright instead of lying horizontally.

The present invention should not be considered as restricted to that described above and shown on the drawings, many modifications being conceivable without departing from the scope of the appended Claims.

What is claimed is:

1. Apparatus for hydroforming workpieces, comprising:

a frame defining a work space;

a first tool part fastened to the frame in the work space;

a second tool part;

conveyor means for inserting the second tool part in a work position in the work space adjacent the first tool part prior to a forming cycle, and for removal of the second tool part from the work space after the forming cycle;

a mold cavity in at least one of the first and second tool part;

means for locating a workpiece between the first and second mold part;

means for urging the first and second tool parts together with the workpiece therebetween in the forming cycle; and means for supplying pressurized fluid to the workpiece between the first and second tool parts through at least one of said first and second tool parts for forming the workpiece in said forming cycle, wherein said means for urging maintains the first and second tool parts together in the forming cycle.

2. Apparatus according to claim 1, wherein said means for supplying pressurized fluid is connected to said first tool part.

3. Apparatus according to claim 1, including a conveyor for inserting the second tool part in a work position in the work space, wherein the first and second tool parts are closable under the action of a press device.

4. Apparatus according to claim 3, wherein the first tool part is immobile in the press device seen in its working direction.

5. Apparatus according to claim 3, wherein the work direction of the press device is substantially vertical, and wherein the press device includes lifting means for lifting the second tool part to a forming position in cooperation with the first tool part.

6. Apparatus according to claim 1, wherein the workpiece is carried by the second tool part, and including sealing means for providing a seal between the first tool part and second tool part during the forming cycle.

7. Apparatus according to claim 1, including a mold cavity in the first tool part.

8. Apparatus according to claim 1, including a mold cavity in the first and second tool part, wherein one of said mold cavities has a bigger cross sectional area than the other, the cross sectional areas being parallel to the plane of the workpiece between forming thereof.

9. Apparatus according to claim 1, wherein said means for urging comprises power means for forcibly urging the second tool part against the first tool part, with the workpiece being firmly clamped therebetween during the forming cycle.

10. Apparatus according to claim 2, wherein said means for supplying pressurized fluid supplies pressurized fluid to the first tool part and distributes said fluid to a surface of the workpiece facing the first tool part during the forming cycle.

11. Method for hydroforming workpieces, which comprises:

fastening a first tool part to a frame in a work space of said frame;

inserting a second tool part in a work position by a conveyor means in said work space adjacent the first tool part prior to a forming cycle;

providing a mold cavity in at least one of the first and second tool parts;

locating a workpiece between the first and second tool parts;

urging the first and second tool parts together with the workpiece therebetween in the forming cycle; and supplying pressurized fluid to the workpiece between the first and second tool parts through at least one of said first and second tool parts for forming the workpiece in said forming cycle, wherein said means for urging maintains the first and second tool parts together in the forming cycle.

12. Method according to claim 11, including the step of removing the second tool part from the work space after the forming cycle by said conveyor means.

13. Method according to claim 11, including connecting a means for supplying pressurized fluid to said first tool part.

14. Method according to claim 11, including holding the first tool part fixed and immobile during said forming cycle and moving the second tool part and workpiece to the first tool part in the forming cycle.

15. Method according to claim 11, including carrying the workpiece by the second tool part, and sealing the first tool part and second tool part together during the forming cycle.

16. Method according to claim 11, including providing a mold cavity in the first tool part.

17. Method according to claim 11, including providing a mold cavity in the first and second tool part, wherein one of said mold cavities has a bigger cross sectional area than the other, the cross sectional areas being parallel to the plane of the workpiece before forming thereof.

18. Method according to claim 11, wherein said means for supplying pressurized fluid supplies pressurized fluid to the first tool part and distributes it to a surface of the workpiece facing the first tool part during the forming cycle.

19. Method according to claim 11, including forcibly urging the second tool part against the first tool part by power means with the workpiece firmly clamped therebetween during the forming cycle.

* * * * *